US005506662A

United States Patent [19]

Morihara

[11] Patent Number: 5,506,662

[45] Date of Patent: Apr. 9, 1996

[54] IMAGE FORMING APPARATUS INCLUDING AN IMAGE BEARING MEMBER AND AN ERASING DEVICE FOR ERASING A PORTION OF AN IMAGE FROM THE IMAGE BEARING MEMBER

[75] Inventor: Kazushige Morihara, Yokohama, Japan

[73] Assignee: Kabushiki Kaisha Toshiba, Kanagawa, Japan

[21] Appl. No.: 277,153

[22] Filed: Jul. 19, 1994

[30] Foreign Application Priority Data

Jul. 19, 1993 [JP] Japan ..... 5-177861

[51] Int. Cl.[6] ..... G03G 21/00

[52] U.S. Cl. ..... 355/218; 355/204

[58] Field of Search ..... 355/204, 208, 355/210, 218, 219, 246

[56] References Cited

U.S. PATENT DOCUMENTS

| | | | |
|---|---|---|---|
| 4,582,417 | 4/1986 | Yagasaki et al. . | |
| 4,634,260 | 1/1987 | Watanabe . | |
| 4,728,985 | 3/1988 | Nakashima et al. | 355/218 X |
| 4,745,438 | 5/1988 | Acquaviva et al. | 355/218 X |
| 4,990,956 | 2/1991 | Iwata | 355/218 |
| 5,030,992 | 7/1991 | Yoneda et al. | 355/218 |
| 5,126,792 | 6/1992 | Iwata | 355/218 |
| 5,126,793 | 6/1992 | Taniguchi et al. | 355/218 |
| 5,257,072 | 10/1993 | Maeda | 355/218 |
| 5,300,985 | 4/1994 | Demott et al. | 355/218 |

*Primary Examiner*—Sandra L. Brasé
*Attorney, Agent, or Firm*—Limbach & Limbach

[57] ABSTRACT

The copying machine has a charge partially erasing device for limiting a region of the photosensitive drum, in which an electrostatic latent image can be formed. The charge partially erasing device includes a plurality of LED elements arranged in the direction of the axis of the photosensitive drum, and the LED elements are turned on in accordance with data stored in the ROM in a predetermined order. The data stored in the ROM can be read out at all times as the document size key of the operation panel is operated, and the charge supplied on the photosensitive drum is partially erased. Further, the number of times the document size key was operated is counted, and a partial erase pattern is selected based on the number of times the was operated. Thus, a specific partially erased image is achieved by a simple operation.

7 Claims, 10 Drawing Sheets

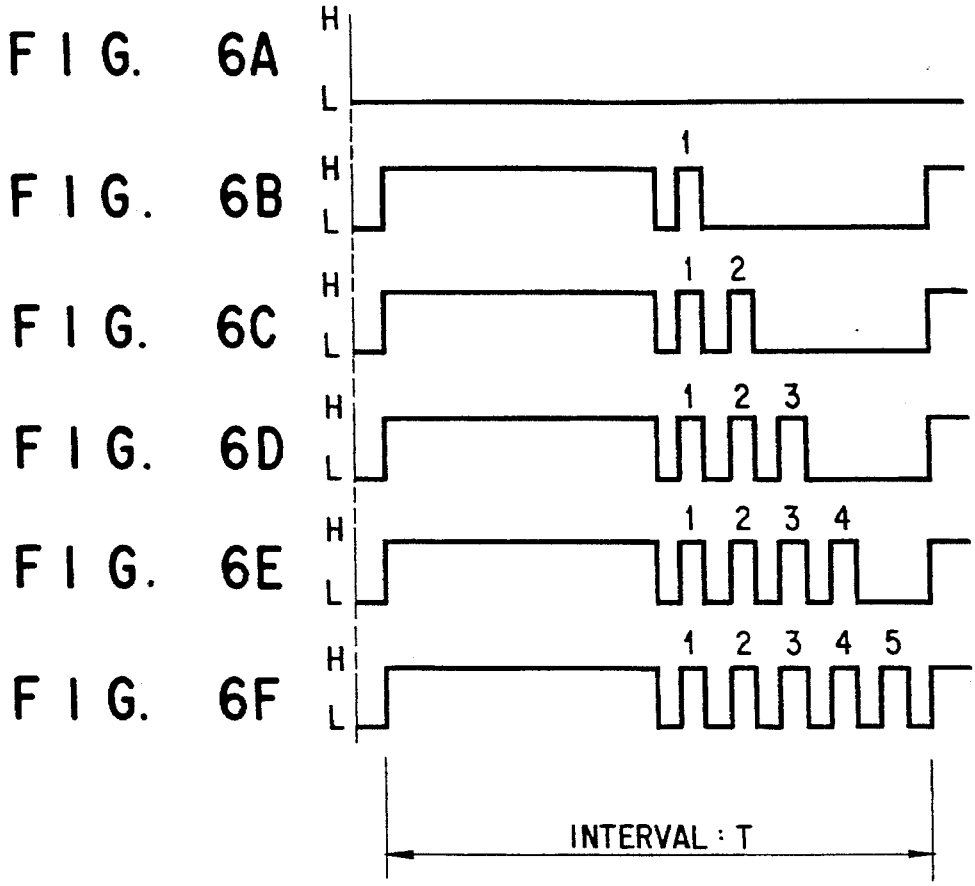
FIG. 7A
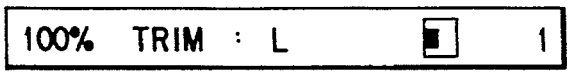
FIG. 7B
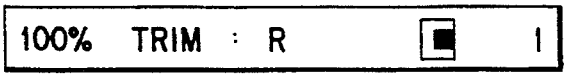
FIG. 7C
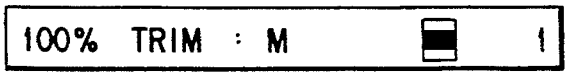
FIG. 7D
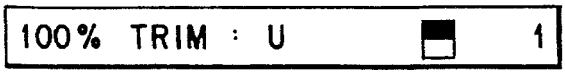
FIG. 7E
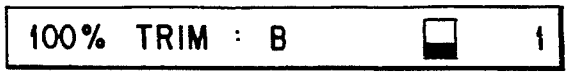

IMAGE FORMING APPARATUS INCLUDING AN IMAGE BEARING MEMBER AND AN ERASING DEVICE FOR ERASING A PORTION OF AN IMAGE FROM THE IMAGE BEARING MEMBER

BACKGROUND OF THE INVENTION

1. Field of the Invention

The present invention relates to a copying machine for copying an image of an object onto a recording material, and more specifically, to a copying machine capable of providing a particular blank area in a copied image based on the result of a comparison of an original and a sheet with respect to size.

2. Description of the Related Art

An image forming apparatus such as an electrostatic copying machine including an image reading portion for reading the image of an object to be copied, an image forming portion for forming a copying image based on the image read out by the image reading portion, and a sheet carrying portion for feeding a copy sheet on which the image formed by the image forming portion is stored.

The image reading portion includes an original document table on which an object is placed, and a document cover for pressing the document positioned on the document table in place. The document cover having a cover portion integrated into the cover, used for ensuring the uniform distribution of the white background of an image obtained by copying.

The document cover is formed to be usable even when the top is opened, so that objects having shapes other than that of a sheet, such as a book or a three-dimensional object can be subjected to the copying operation.

The image forming portion includes a photosensitive member on which an electrostatic latent image is formed in accordance with the image read out, a developing device for supplying toner on the latent image formed on the photosensitive member, and a copy starting switch for instructing the start of formation of the image.

In the case where the object is a book or a three-dimensional object, it commonly happens that an undesirable black margin (toner image) occurs in the background, that is, around the copied image, since the document cover is released or is not closed completely. In the case where a copy sheet larger than the size of an image defined in accordance with an object to be copied or a copying magnification is used, a black margin of a similar type can occur around the image formed on a sheet, since the cover is opened.

In order to remove such a black margin, a technique of covering the periphery (the area to be blank) of the object in advance with blank paper has been proposed.

Further, in accordance with an increase in the number of functions of the copying machine, a number of optional functions have recently been proposed, such as a partial erase function for erasing a black margin, and a trimming function for copying only the image data of the necessary image area.

However, even in the case where the partial erase function or the trimming function is provided, such a function is, in practice, rarely used, since the operation of specifying (inputting) the area to be erased (trimmed) is complicated. Moreover, with the manual paper feeding mode, the black margin cannot be erased in many cases, since the length of the sheet cannot be identified until a required length of at least one sheet has been fed into the copying machine.

Therefore, even with the copying machine having the partial erase function or trimming function, when a book or a three-dimensional object is subjected to copying (or when a sheet larger than the image obtained by copying is used), a black margin is likely to occur in the peripheral region of the copied image, thereby causing unnecessary consumption of the toner contained in the developing device. As a result, the replenishment of the toner in the developing device cannot keep level with its consumption, resulting in a decrease in the image density of copied images in subsequent operations. Further, the number of copies which can be achieved with a certain amount of toner is decreased, thereby increasing the cost of copying as a whole.

Moreover, the technique of covering the peripheral region of an object with blank paper results in an decrease in the efficiency of the copying operation, and excessive consumption of blank paper, which is unnecessary in recording of an image.

SUMMARY OF THE INVENTION

The present invention has been proposed in consideration of the aforementioned drawbacks, and an object of the present invention is to provide an image forming apparatus having a high operability.

Another purpose of the invention is to provide an image forming apparatus capable of erasing a black margin created in the peripheral region of an image when an object is a book or three-dimensional material, and an image to be copied is copied on a sheet larger than the size of the image.

Still another purpose of the invention is to provide a partial editorial function and a trimming function, which satisfy the certain conditions and can be easily operated.

The above object can be achieved by an image forming apparatus for reading an image of an original and forming a read image on an image bearing member, comprising: means for designating a size of the original; means for storing a plurality of erase patterns in accordance with the size of the original designated by the designating means; means for selecting one erase pattern out of the plurality of erase patterns stored in the storing means; means for applying a charge uniformly on the image bearing member; and means for erasing a portion of the charge applied on the image bearing member by the applying means in accordance with the erase pattern selected by the selecting means, which is applied in a region other than a region corresponding to the original size selected by the selecting means.

Further, according to the present invention, there is provided an image forming apparatus for forming an image on a photosensitive member based on a read image read from an original, and transferring the image formed on the photosensitive member on a sheet, comprising: original size designation means for designating a size of the original; first storage means for storing a plurality of erase areas in accordance with the size of the original designated by the original size designation means; sheet size designation means for designating a size of the sheet; second storage means for storing a plurality of erase areas in accordance with the size of the sheet designated by the sheet size designation means; first selection means for selecting a first erase area out of the plurality of erase areas stored in the first storage means; second selection means for selecting a second erase area out of the plurality of erase areas stored in the second storage means; means for applying a charge uniformly on the photosensitive member; and means for erasing a portion of the charge applied on the photosensitive member by the applying means, which corresponds to an area belonging to at least one of the first erase area selected by the first selection means and the second erase area selected by the second selection means.

Still further, according to the present invention, there is provided an image forming apparatus comprising: a photosensitive member; means for applying a charge uniformly on the photosensitive member; means for selectively lighting so as to remove a portion of the charge applied on the applying means, the lighting means having a plurality of light emitting elements arranged so as to be close to the photosensitive member, and over an entire width of the photosensitive member in a rotational axis direction of the photosensitive member; means for storing a plurality of erase patterns used to erase an image located within a predetermined range with respect to a sheet having a predetermined size; means for selecting one erase pattern out of the plurality of image erase patterns stored in the storing means; and means for controlling the lighting means to remove a portion of the charge from the photosensitive member on a surface of which the charge was uniformly applied, which corresponds to the image erase pattern, by lighting light-emitting elements in accordance with the image erase pattern selected by the selecting means.

with the image forming apparatus of the present invention, the charge supplied from the charging means to the image carrier is partially erased by charge partially erasing means based on the data corresponding to the size of the object, input via the instructing means. The charge partially erasing means prevents toner from adsorbing on an originally unnecessary image forming region, thus avoiding an unnecessary consumption of toner. The charge partially erasing means can be activated simply by inputting the size of an object and an erasing pattern of a partial erase, and thus the problem of a complicated input operation can be solved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 6A to 6F are timing charts each showing a flashing pattern of a document size LED (display LED), the timing charts corresponding to the lighting patterns of the charge partially erasing device, shown in FIG. 4;

FIGS. 7A to 7E are diagrams each showing a display example of the display panel, which corresponds to the respective each one of the lighting patterns of the charge partially erasing device shown in FIGS. 5A to 5E;

DETAILED DESCRIPTION OF THE PREFERRED EMBODIMENT

An embodiment of the present invention will now be described with reference to accompanying drawings.

Figure 1:
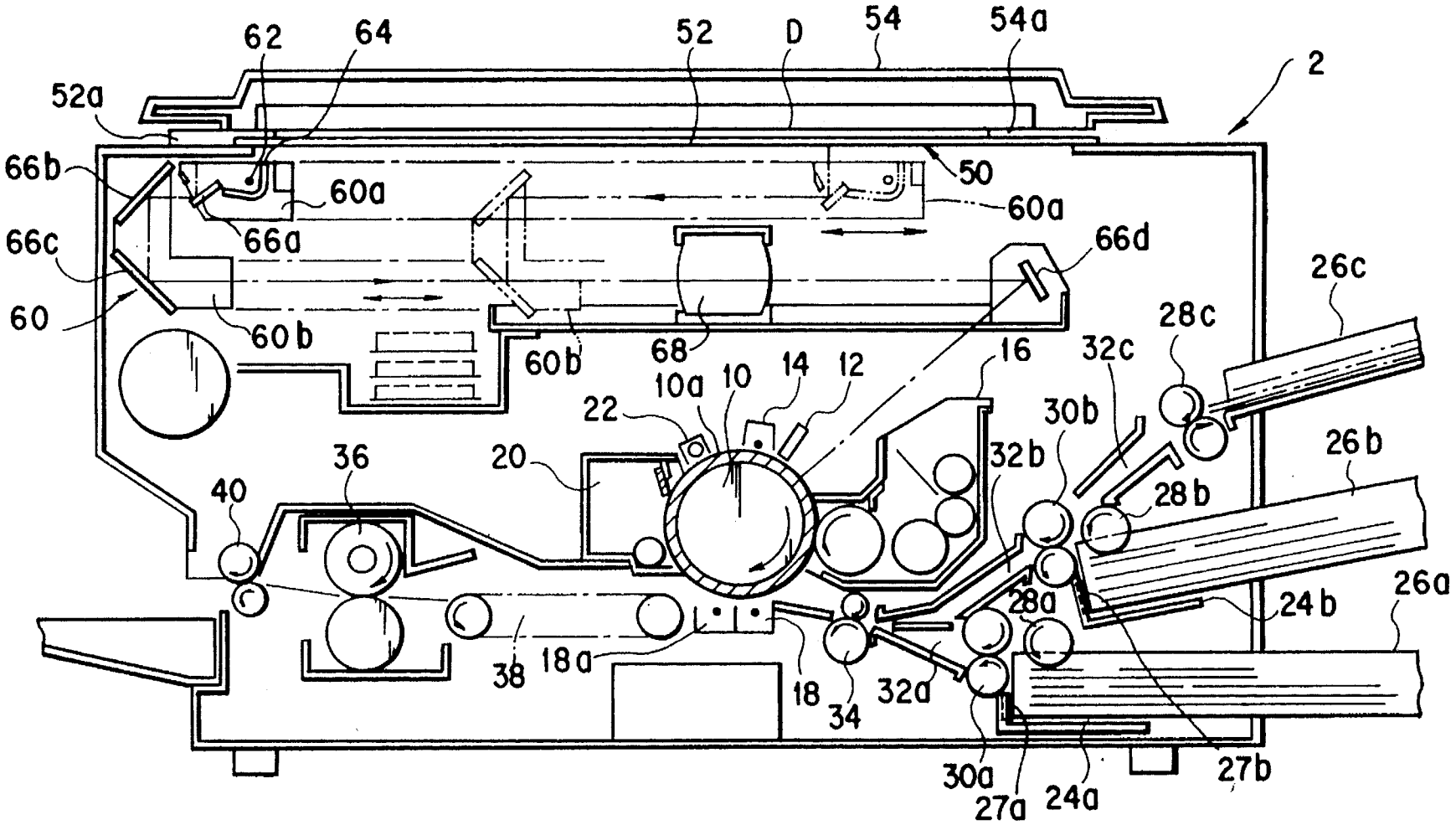
FIG. 1 is a schematic diagram showing a copying machine to which an embodiment of the present invention is provided.

As can be seen in FIG. 1, an image forming apparatus, that is, an electrostatic-type copying machine 2 has a photosensitive drum 10 situated at its substantially center portion, so as to be rotatable in the direction indicated by a drive motor not shown in this drawing. The photosensitive drum 10 made of a cylinder of aluminum, and a photosensitive layer 10*a*, that is a photosensitive thin layer of amorphous silicon or the like, formed around the cylinder. When the photosensitive layer 10*a* is irradiated with light while a predetermined potential is applied thereto, a charge distribution pattern, that is, an electrostatic latent image, can be provided.

Around the photosensitive drum 10, a charge partially erasing device 12, a charge device 14, a developer device 16, an image transfer device 18, a cleaning device 20, a charge removing device 22, and the like are arranged in order along the rotating direction of the photosensitive drum 10.

The charge partially erasing device 12 includes a number of LED elements arranged along the axial line of the photosensitive drum 10, and each of which can be arbitrarily turned on, and the charge partially erasing device 12 serves to change the size of an area on which the photosensitive layer 10*a* can maintain the potential, that is, an image forming area. In other words, the charge partially erasing device 12 can arbitrarily limit the width of an image which can be formed on the photosensitive layer 10*a* by accordingly removing a potential on the area of the photosensitive layer 10*a* which is charged. Further, as the photosensitive drum 10 is rotated while arbitrary LED elements are turned on, the length of an image which can be formed can be arbitrarily limited. The charge partially erasing device 12 is able to use a LED array, for erasing an arbitrarily area on the photosensitive drum 10 based on inputting data of trimming task/masking task, also.

For example, in the case where the maximum copy width of the photosensitive drum 10 is the width corresponding to an A3 type sheet, and the copying on a B4 sheet was requested, the potential of the areas corresponding to the blank portion created due to the difference between the A3 and B4 sheets in width, and corresponding to the portion corresponding to the length of the A3 sheet which exceeds the length of the B4 sheet, can be removed. Or, in the case where the size of the document is B4, the copying magnification of 100% is assigned, and an A3 sheet is selected as a copy sheet, a blank is provided in the section of the copy sheet, which corresponds to an area of the copy sheet not taken up by the original document, by the easy edit mode, which will be explained later. It should be noted that area data in which LED elements are turned on, is stored in advance in a ROM so that the area data can cope with various conditions.

The charge device 14 includes a corona wire extending along the axial line of the photosensitive drum 10, a grid screen for limiting the amount of charge supplied to the photosensitive layer 10*a* via the corona wire, and a shield case for blocking charge output via the corona wire from heading in directions other than that of the photosensitive layer 10*a*, and this device 14 is used for charging the photosensitive layer 10*a* at a given potential. The charge device 14 is activated continuously or intermittently by a charge control device (not shown) in accordance with the copying conditions (the number of copies) input. As the device 14 is activated independently or in couple with the charge partially erasing device 12, the area of potential uniformaly applied to the photosensitive layer 10*a* along the direction of the rotation of the photosensitive drum 10.

The developing device 16 includes a toner container portion for containing a visualizing agent or toner, and a developing roller arranged to be substantially parallel with the axial line of the photosensitive drum 10. As will be described later, when the photosensitive layer 10*a* is irradiated with light reflected from an object for copying (i.e. image data), a charge distribution pattern, i.e. an electrostatic latent image, is formed on the photosensitive layer 10*a*. An electrostatic latent image is developed by supplying toner to the latent image.

The image transfer device 18 includes a corona wire capable of functioning substantially the same as the charge device 14 and a shield case for blocking the charge output via the corona wire from heading in the directions other than that of the photosensitive layer 10*a*, and the device 18 serves to transfer the developed image, i.e. toner image, obtained by the developing device 16 on an image-transferred material, i.e. a copy sheet, described later. The transfer device 18 has a separating device 18*a* integrally formed in the device 18, which generates an AC electrical field in order to separate the sheet from the surface (photosensitive layer 10*a*) of the photosensitive drum 10.

The cleaning device 20 is situated such that the device can be brought into tight contact with the photosensitive layer 10*a*. This device 20 has a scraper for scraping off the toner on the photosensitive layer 10*a*, and is used for removing the not-transferred toner remaining on the photosensitive layer 10*a* after the toner image is transferred by the transfer device 18, from the layer 10*a*.

The charge removing device 22 is a lamp which extends along the axial line of the photosensitive 10*a*, and is used for removing a charge distribution pattern remaining on the photosensitive layer 10*a*.

In the right side of the copying machine 2, a plurality of slots 24*a* and 24*b* into which sheet cassettes, which will be described, are inserted, are formed. In to the slots 24*a* and 24*b*, sheet cassettes 26*a* and 26*b* for supplying copy sheets or OHP sheets or the like towards the photosensitive drum 10, are inserted. Above the sheet cassette 26*b*, a bypass tray 26*c* capable of occasionally feeding a sheet having a different size (may be the same size) from those of the cassettes, or a sheet on one side of which an image is already formed so as to form an image on the other side of the sheet. Size detection switches 27*a* and 27*b* for detecting a size of the copy sheets stored in the sheet cassettes of each are arranged in the slots 24*a* and 24*b*, respectively. The size detection switches 27*a* and 27*b* having microswitches, and each detects the sheet size stored in each of the sheet cassettes based on one or more projections mounted on the sheet cassettes corresponding to the sheet size stored in each of the cassettes.

Between the photosensitive drum 10, the sheet cassettes 26*a* and 26*b* (slots 24*a* and 24*b*), and the bypass tray 26*c*, first and second paper feeding rollers 28*a* and 28*b* for withdraw a sheet separately from the cassette 26*a* or 26*b*, a bypass paper feeding roller 28*c* for feeding out a sheet inserted to the bypass tray 26*c* towards the second paper feeding roller 28*b*, first and second conveying rollers 30*a* and 30*b* for conveying the sheet fed via the paper feeding roller 28*a* or 28*b*, towards the photosensitive drum 10, sheet delivering pathways 32*a*, 32*b* and 32*c* for guiding the sheet directed towards the photosensitive drum 10, and a pair of timing rollers 34 for correcting the inclination of the sheet, aligning the leading head of the image formed on the photosensitive drum 10 with the leading head of the sheet, and feeding the sheet at the same speed as the rotation speed of the photosensitive drum 10, are arranged in order.

At a position relatively away from the photosensitive drum 10 and on the side the copy sheet onto which the toner image is already transferred by the transfer device 18 is conveyed as the photosensitive drum 10 is rotated, a fixing device 36 for fixing the toner (image) electrostatically adhered to the sheet thereon is situated.

The fixing device 36 includes a heat roller having a heater, a press roller in tight contact with the heat roller. When the toner adhered to the sheet is heated, the toner is melted, and when the melted toner and the sheet is pressed, the toner is fixed on the sheet.

Between the transfer device 18 and the fixing device 36, a conveying belt 38 for delivering a sheet on which a toner image is already transferred (copied) by the image transfer device 18, towards the fixing device 36 is situated, and further on the side the sheet on which the toner image is fixed by the fixing device 36 is sent, an output roller 40 for outputting the sheet to the outside of the apparatus 2 is provided.

Figure 2:
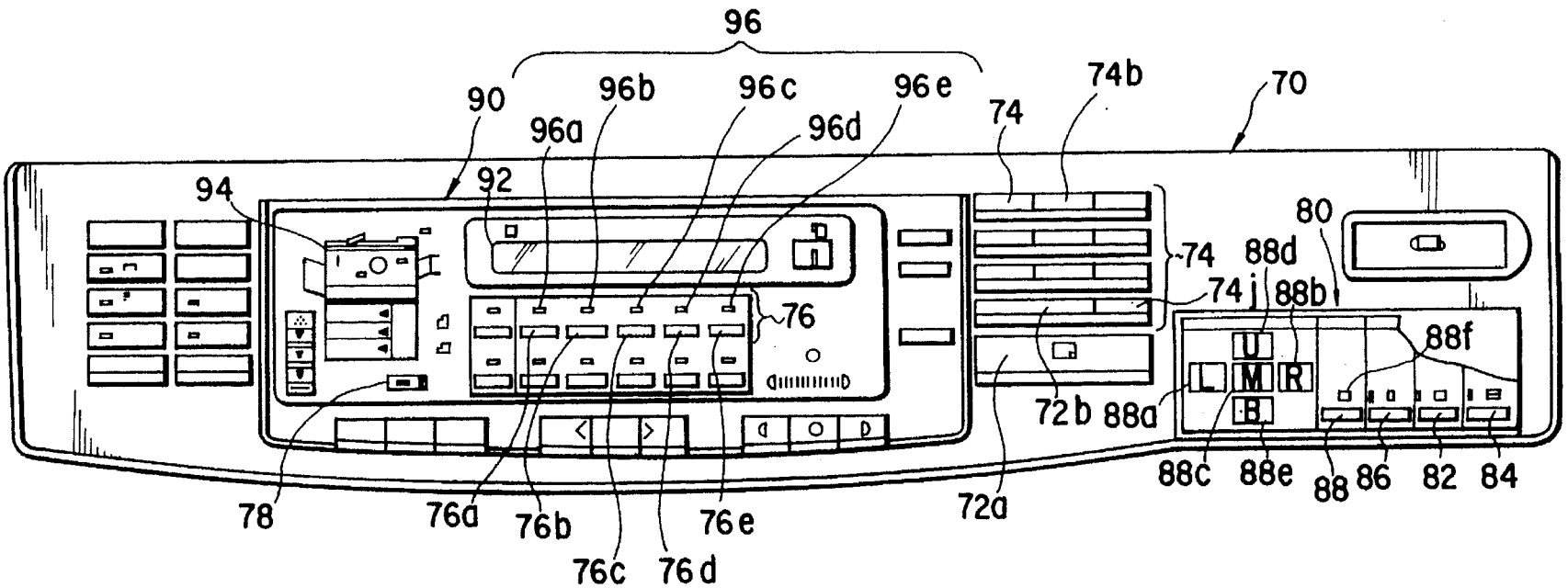
FIG. 2 is a schematic plan view showing an operation panel of the copying machine shown in FIG. 1.

Above the photosensitive drum 10, an original holding section 50 on which a to-be-copied object such as a book or a document is placed, a document read portion 60 for transmitting an image of the original document placed on the original holding section 50, to the photosensitive layer 10 of the photosensitive drum 10, and an operation panel 70 (see FIG. 2) for inputting various copying conditions and a signal of starting a copy operation, are arranged.

The original holding section 50 has a document table 52 on which a document D is placed, a document guide plate 52*a* situated at leading end of the document table 52, for indicating the position to which the document D is placed, and a cover 54 formed to be openable with respect to the document table 52, for holding the document D placed on the document table 52 tightly thereon. The document table 52 is formed of, plate glass, and serves to irradiate the document surface of the document D with light from the illumination lamp, which will be later described, and transmit the light reflected on the document surface to the document read portion 60 as image data.

The document read portion 60 has an illumination lamp 62 for illuminating the document placed on the document table 52, a reflector for concentrating the light from the illumination lamp 62 on a predetermined position of the document, a plurality of reflection mirrors 66*a*, 66*b*, 66*c* and 66*d* for transmitting the reflection light (image data) from the document to the photosensitive layer 10*a* of the photosensitive drum 10, and a lens 68, arranged between the reflection mirrors 66*c* and 66*d*, for stabilizing the optical characteristics of the reflection light from the document. The illumination lamp 62, the reflector 64 and the reflection mirror 66*a* are integrally formed as a first carriage 60*a*, and are moved in parallel with the document table 52 at a speed corresponding to the copying magnification used for the original document to be copied. Similarly, the reflection mirrors 66*b* and 66*c* are formed integrally as a second carriage 60*b*, which is driven parallel with the first carriage 60*a* as a half speed of the first carriage 60*a*.

The operation panel 70 includes a copy start key 72*a* for outputting a copy start signal in response to an operation by the used, an all-clear key 72*b* for suspending the copying operation, outputting a signal of resetting data being input to "0", and for resetting all inputs and operations to the initial state, numeral keys for inputting numeral data from 0 to 9, used for setting a plural number of copies or a copying magnification, a group of document size keys 76 (76*a*, . . . ) for inputting the size of the document placed on the document table 52, and a cassette switch key 78 for switching a sheet cassette for feeding sheets, described later, to another.

The operation panel 70 has an edit input portion 80 by which a partial erase or a simplified edit mode can be set in accordance with an input from the user. The edit input portion 80 includes a trimming mode key 82 for setting a trimming mode which is used to copy an extract from a part of the image of the document, a masking mode key 84 for setting a masking mode which is used to copy as a part of the image of the document is erased, a margin erase mode key 86 for setting a margin erase mode which is used to form a black in the periphery portion of an image (formed on the photosensitive layer 10*a*) output on a sheet based on the size of the copy sheet, and a simplified edit mode key 88 for setting the simplified edit mode which is used to partially erase the image (formed on the photosensitive layer 10*a*) output on the sheet based on the partial erase pattern stored in advance in the ROM, which will be described later. The simplified edit mode key 88 has a group of edit area entry key pads 88*a* to 88*e* for inputting trimming patterns of the simplified edit mode, and a simplified edit mode display LED 88*f* located near the simplified edit key 88.

The operation panel 70 has a display portion integrally built in the panel, capable of displaying data input (number of copies, copying magnification, edit data, or the like) and the operation state of the apparatus 2. The display portion 90 includes a liquid crystal display (to be called LCD hereinafter) 92 for displaying the procedure of the operation (edit mode input) of the apparatus 2, the timing for feeding a copy sheet or replenishing toner T, and error messages, a monitor LED 94 for displaying the operation states of the apparatus 2, for example, the position of the selected cassette and the position of the paper jamming inside the apparatus 2, and a plurality of LED elements 96 (96*a*, . . . ) for indicating that the size of the sheet, i.e. an area which can be subjected to copy, is specified via the group of document size keys 76 (76*a*, 76*b*, . . . ). The group of LED elements 96 (96*a*, . . . ) and the simplified edit mode display LED 88*f* are flashed at predetermined intervals when the simplified edit mode is selected, and is used to indicate the selected simplified edit mode.

Figure 3:
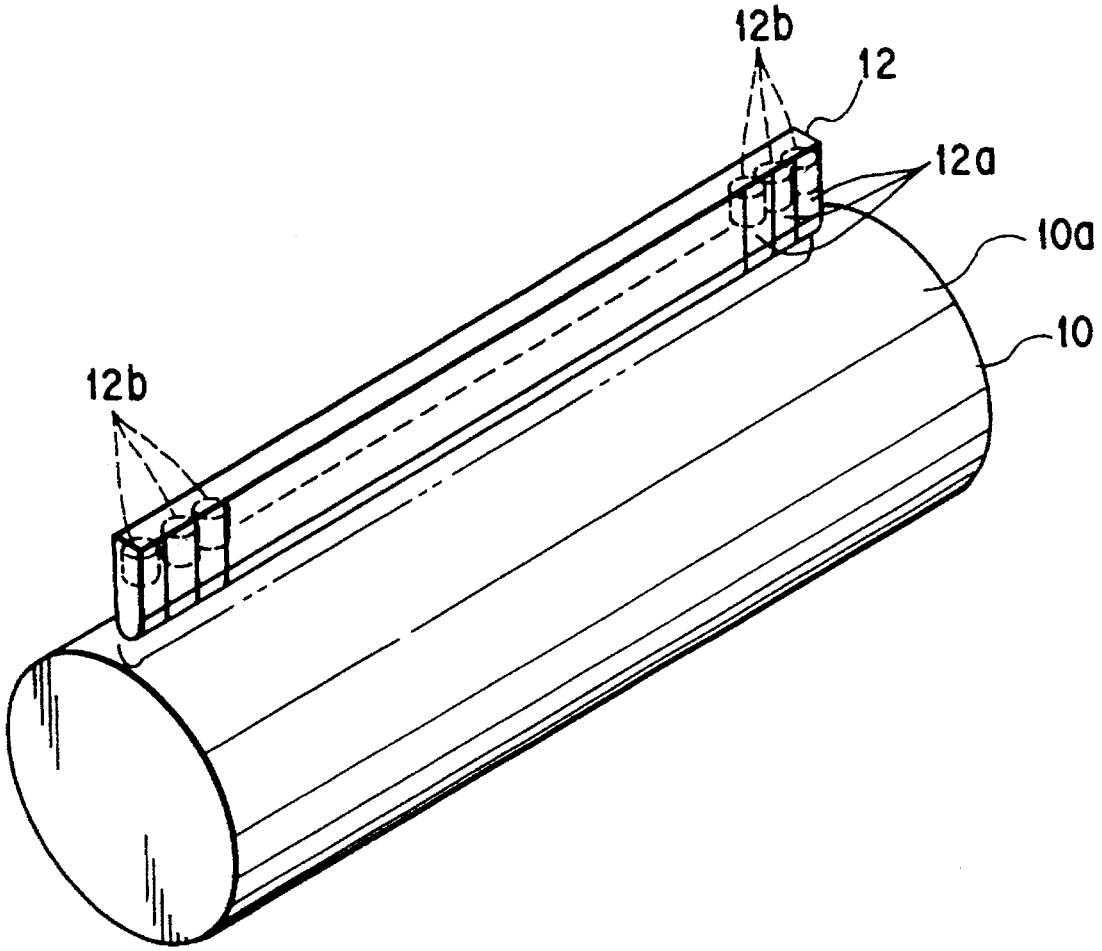
FIG. 3 is a perspective view schematically showing a charge partially erasing device of the copying machine shown in FIG. 1.

As shown in FIG. 3, the charge partially erasing device 12 includes a plurality of light shielding cells 12*a* extending in the direction crossing with the axial line of the photosensitive drum 10, and LED elements 12*b* each provided in each light shielding cell 12*a*. Each LED elements 12*b* is turned on arbitrarily in accordance with the sheet size data stored in the ROM. In the case where the maximum sheet size subjected to copy is A3, the significant length of the photosensitive drum 10 in the axial line direction is about 300 mm, which is slightly longer than the length of the short side of A3 sheet, and 150 of the LED elements 12*b* are arranged at a pitch of 2 mm. Therefore, when the copy sheet is A3 and A4 size copy sheet is conveyed in the direction crossing with the longitudinal direction thereof (to be called laterally placed A4 hereinafter), the LED elements 12*b* located at both ends are turned on. When the copy sheet is B4 and B5 size copy sheet is conveyed in the direction crossing with the longitudinal direction thereof (to be called laterally placed B5 hereinafter), the LED elements 12*b* located at both ends and the number of those corresponding to the length of the blank obtained by (A3 sheet width - B4 sheet width)/2 are turned on. Since the length of the short side of A3 sheet (=297 mm)—the length of the short side of B4 sheet (=257 mm) is 40 mm, and the length covered by the LED elements 12*b* is 40/2=20 mm; therefore the number of LED elements 12*b* 20/2=10. It should be noted that the lateral direction is a direction in which the short side of a sheet is in parallel with the scanning direction which is the direction in which the first and second carriages are moved, whereas the longitudinal direction is the direction in which the long side of a sheet is in parallel with the scanning direction. The erase LEDs 12*b* can be turned on in the state in which they are divided into either a back side or front side with respect to the center of the apparatus 2.

When the margin erase key 86 is operated, the margin erase mode is selected. Those of the LED elements 12*b* predetermined are turned on so as to erase an image created in the periphery portion of a sheet, by a predetermined width, in accordance with the size of the sheet detected by the size detection switch 27*a* and 27*b* provided in the slots 24*a* and 24*b*. In this case, the lighting of the LED elements 12*b* is performed in synchronous with the rotation the of the photosensitive drum 10, and all the LED elements 12*b* are turned at positions corresponding to the head end and tail end portions of an image formed on the photosensitive layer 10*a*.

Figure 4:
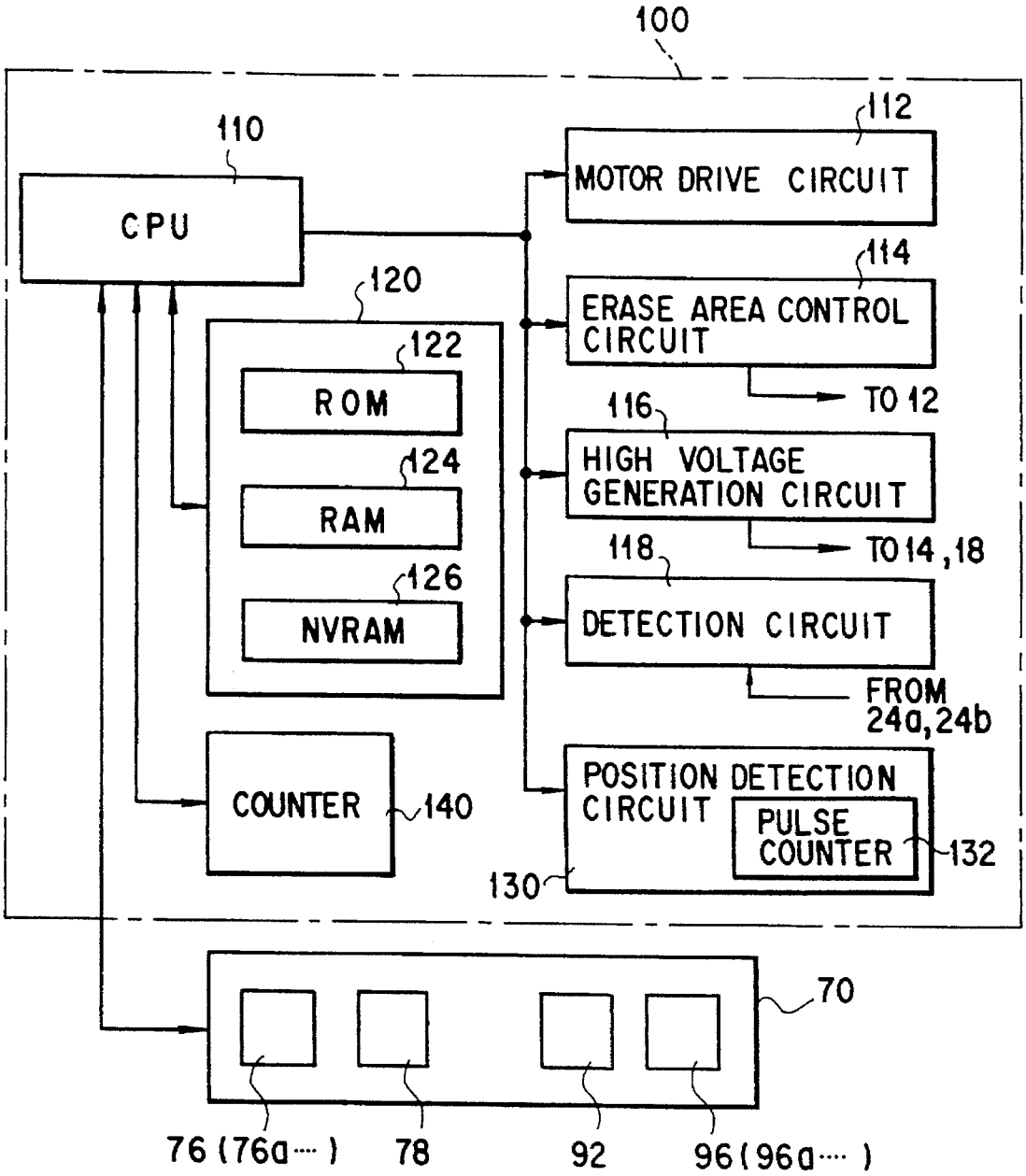
FIG. 4 is a schematic block diagram showing a control portion of the copying machine shown in FIG. 1.

As shown in FIG. 4, the control portion 100 includes a main control device, i.e. CPU 110, for operating a plurality of mechanisms and circuits. The main control device (CPU) 110 is connected to the operation panel 70 shown in FIG. 2, a number of mechanisms and circuits constitute the apparatus 2, for example, a motor drive circuit 112 for rotating a motor not shown, an erase area control circuit 114 for turning on LED elements 12*b* of the charge partially erasing device 12 in accordance with the data from the ROM, a high-voltage generating circuit 116 for generating a high voltage applied to the charge device 14 and the transfer device 18, and a detection circuit 118 which receives signals from the sensor group not shown, and to control these mechanisms and circuits.

The main control device 110 is further connected to a memory 120 for storing predetermined various data or data input via the operation panel 70, a position detection circuit for detecting the rotating states of the photosensitive drum 10 and the timing roller 34 and the moving state of the first carriage 60*a*, a counter 140 for counting the number of times the document size key 76 (76*a*, 76*b*, . . . ) is operated in the simplified edit mode, and the like.

The memory 120 includes a read-only memory, ROM 122 for storing predetermined numeral data or control data for operating the apparatus 2, a random access memory, RAM 124 for temporarily storing copy condition data or the like, input via the operation panel 70, and a non-volatile memory, NVM 126 for storing adjustment data, for example, a reference voltage for turning on the illumination lamp 62. In the RAM 124 and the NVM 126, data is written in accordance with necessity, and predetermined data is read out collectively or solely from the ROM 122, the RAM 124 and the NVM 126.

For example, the ROM 122 stores the data of the positions of the LED elements 12*b* of the charge partially erasing device 12 are turned on, which corresponds to the size of a document utilized in the simplified edit mode, the data of the positions of the LED elements 12*b*, which are defined by the size of a copy sheet and a copying magnification, are turned on the data of an amount of moving of the first carriage 60*a*, i.e. an amount of drive pulse per predetermined periodic supplied to a pulse motor not shown, the signal data output when each of the keys of the operation panel 70 is turned on, and the like. The RAM 124 temporarily stores data input via the operation panel 70, for example, data of setting a copying magnification, image density and edit mode until the all-clear key 72*b* is operated.

The position detection circuit 130 includes a pulse counter 132 and to detect the position of an image formed on the photosensitive layer 10*a* of the photosensitive drum 10, the position of a sheet separated from the timing roller 34, and the position of the first carriage 60*a* after a rotation of the pulse motor not shown, so as to count the pulses by pulse counter 132.

FIGS. 5A to 5E show examples of the lighting pattern (indicating an image formable area on the photosensitive drum, which is partially erased) of the LED elements 12*b* for the simplified edit mode stored in the ROM 122.

Figure 5A:
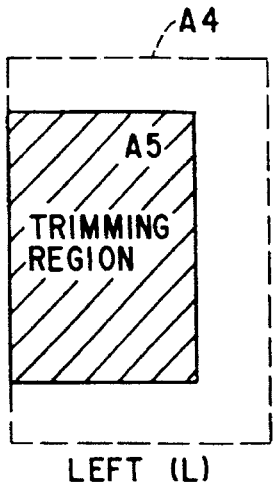
FIGS. 5A to 5E are schematic diagrams showing lighting patterns (each corresponding to a partially erased area) of the charge partially erasing device of the copying machine shown in FIG. 1.
Figure 5B:
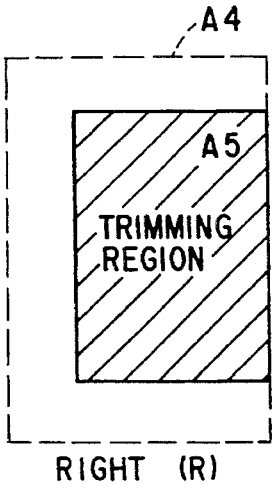

FIGS. 5A to 5E also shows examples of the simplified edit mode for providing a blank in the periphery portion of the image of the original document when the image is copied on a copy sheet which is larger than (or the same as) the document. For example, FIG. 5A illustrates a pattern in which an image having the same size as that of a laterally placed A5 document is copied in the left side of the center portion of a laterally placed A4 sheet (the trimmed image forming area is arranged at the left-hand side of the laterally placed A5 sheet; L=LEFT). FIG. 5B illustrates a pattern in which an image of a laterally placed A5 document is copied in the right-hand side of the center portion of a laterally placed A4 sheet (the trimmed image forming area is arranged at the right-hand side of the laterally placed A5 sheet; R=RIGHT).

During the partial erasing or trimming illustrated in FIGS. 5A and 5B, LED elements 12*b* of the charge partially erasing device 12 are continuously turned on in the number of the LED elements corresponding to the length of the blank, obtained by "(width of laterally placed A4 sheet (297 mm)—width of laterally placed A5 sheet (210 mm))/2", that is, 87/2, rounded up to 44, and 44/2=22 elements), and all the LED elements 12*b* are turned on at a timing predetermined based on the trimming to the left-hand side or the right-hand side.

Figure 5C:
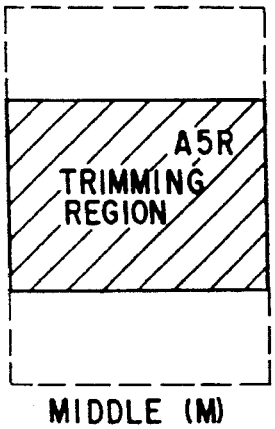

FIG. 5C illustrates a pattern in which an image having the same size as that of a longitudinally placed A5 document is copied in the center portion of a laterally placed A4 sheet (the trimmed image forming area is arranged at the central portion in the longitudinal direction the laterally placed A4 sheet, M=MIDDLE). In this case, LED elements 12*b* of the charge partially erasing device 12 are continuously turned on in the number of the LED elements corresponding to the length of the blank, obtained by "(width of laterally placed A4 sheet (297 mm)—width of longitudinally placed A5 sheet (148.5 mm))/2", that is, 37 (elements).

Figure 5D:
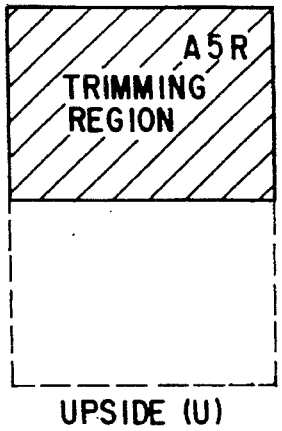
Figure 5E:
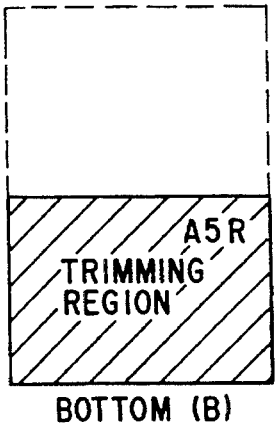

FIGS. 5D and 5E shows examples of the pattern in which an image having an area corresponding to that of a longitudinally placed A5 is copied on a laterally placed A4 sheet, as the image moved in the longitudinal direction (an image having a size corresponding to a laterally placed A5 sheet is trimmed to an end portion or the other end portion in the longitudinal direction of a laterally placed A4 sheet; U=UPSIDE, B=BOTTOM). In this case, the LED elements 12*b* are turned on in the state in which they are divided into two, either a back side or front side with respect to the center of the apparatus 2. It should be noted that all the trimming patterns (partial erasing) are not limited to A4 to A5 shown in FIGS. 5A to 5E. For example, a combination may be A5 document and B4 copy sheet, or B5 document and B4 copy sheet. The trimming patterns are indicated by letters L, R, M, U and B, respectively.

FIGS. 6A to 6F shows examples of the flashing pattern of LED elements 96 (96*a*, . . . ) and the LED 88*f* which indicate that partial erase patterns (simplified edit) shown in FIGS. 5A to 5E are selected. In this case, the one of the group of LED 96 (96*a*, . . . ) is flashed correspond to a document size (group of size key 76 (76*a* . . . . ) utilized and the LED 88*f* is also flashed for inputting of a trimming region) is selected with the user's operates, in an interval T.

FIG. 6A illustrates a state in which no pad of the simplified edit key 88 is turned on. Each of FIGS. 6B and 6C illustrates an example of a display corresponding to the respective one of the trimming patterns L and R shown in FIGS. 5A and 5B. Similarly, Each of FIGS. 6D, 6E and 6F illustrates an example of a display (flashing pattern) of the respective one of the trimming patterns M, U and B.

With the flashing patterns at least one of the group of LED elements 96 (96*a*, . . . ) and the LED 88*f* shown in FIGS. 6B to 6F, the operation state of the simplified edit mode can be displayed on a relatively small-scaled copying machine without a message display portion.

FIGS. 7A to 7E shows examples of the display pattern to be displayed on the LCD 92, indicating that the partial erase pattern of the respective one of FIGS. 5A to 5E is selected.

For example, the partial erase patterns L, R, M, U and B shown in FIGS. 5A to 5E are displayed on the LCD 92 of the operation panel 70 as shown in FIGS. 7A to 7E.

Next, the characteristics of the operation of the copying machine 2 of the present invention will be described.

Figure 8A:
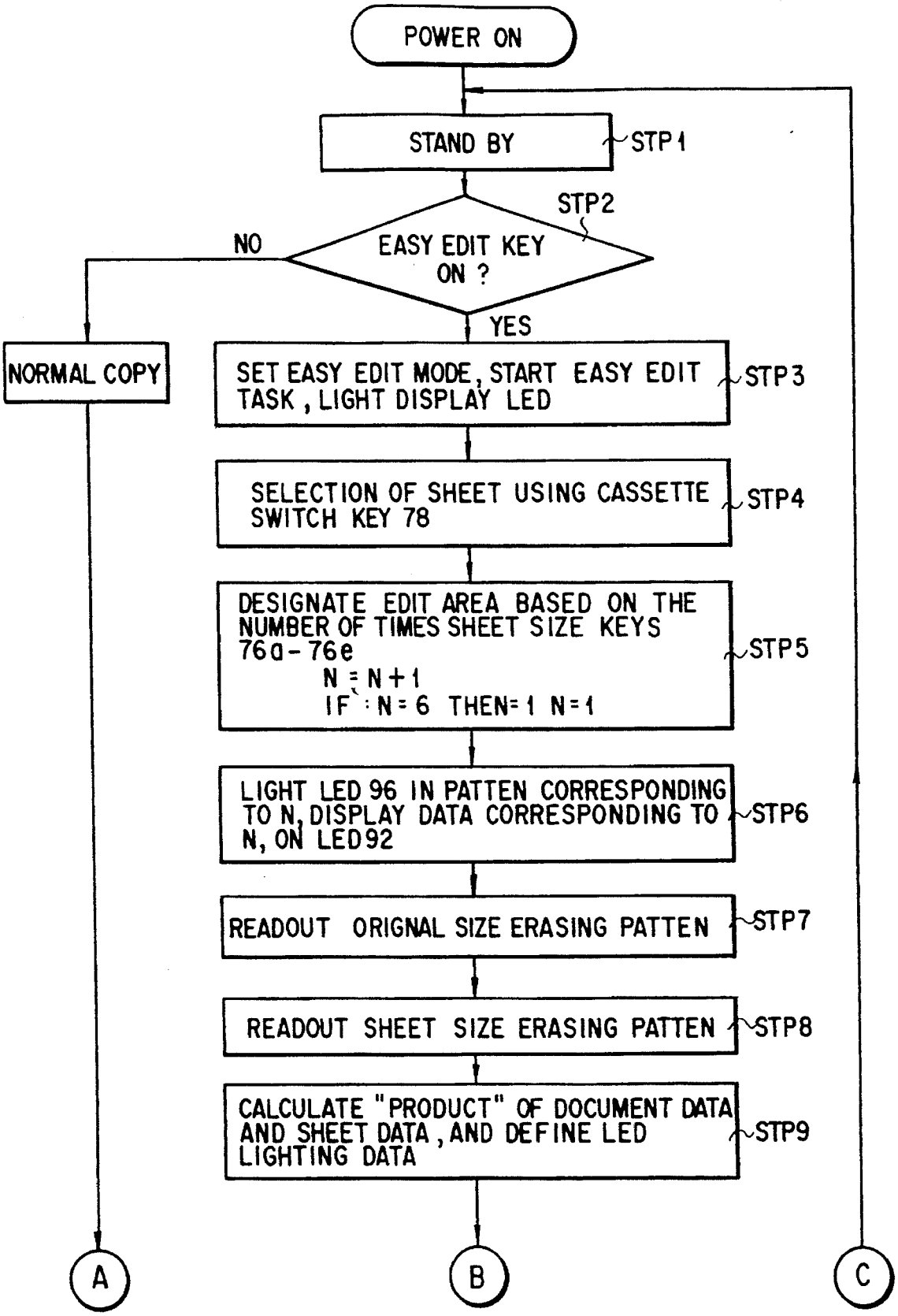
FIGS. 8A and 8B are flowcharts showing the characteristic operation of the copying machine shown in FIG. 1.
Figure 8B:
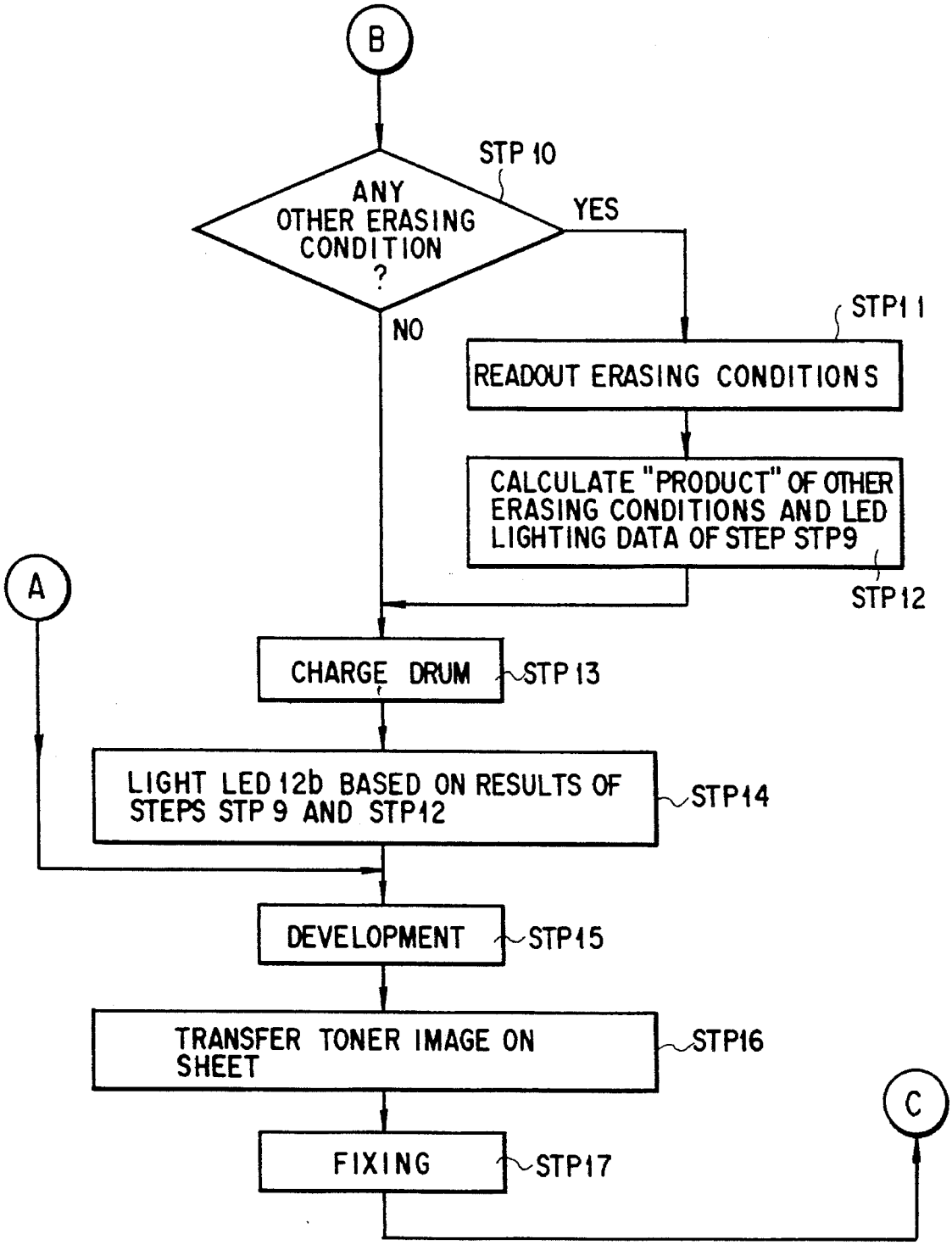

As shown in FIGS. 8A and 8B, when the power switch (not shown) of the copying machine 2 is operated, control data are successively read out from the ROM 122 via the CPU 110, and the machine 2 is warmed up based on the control data, setting a standby (copy enable) state. More specifically, the motor (not shown) is activated by the control of the CPU 110 via the motor drive circuit 112, so as to rotate the photosensitive drum and the developing device 16, the charge device 14, the transfer device 18 and the charge removal device 22 are activated by the high-voltage generating circuit 16 and the charge removal device driving circuit not shown, thus aging the photosensitive layer 10*a* of the photosensitive drum 10. Also, a heater roller (not shown) of the fixing device 36 is activated by a power supply (not shown), the heater roller is heated predetermined temperature (STP 1).

In the case where the simplified edit key 88 is not turned on in the standby state of the step STP 1, a regular copying operation can be carried out (STP 2 - No).

In the case where the simplified edit key 88 is turned on (STP 2 - Yes), the simplified edit task stored in the ROM 122 is read out by the control of the CPU 110, and the flag of the easy edit task in the RAM (not shown) is switched from "0" to "1", thus starting the easy edit task. When the flag of the easy edit task in the RAM is switched to "1", the simplified edit mode display LED 88*f* is turned on (STP 3).

In the simplified edit mode, a sheet having a predetermined size stored in a plurality of cassettes 26*a* and 26*b* is selected using the cassette switch key 78 (STP 4).

with use of the simplified edit mode, the size of a region to be copied is input via one of the document size key 76*a*, 76*b*, . . . . , and therefore the range in which the LED elements 12*b* of the charge partially erasing device 12 are turned on, is determined so as to fit a size of the region to be copied input via one of the document size key 76*a*, 76*b*, . . . , if the size of a sheet is different from that of the region to be copied of the document, in particular, if the size of a sheet is larger than that of the region to be copied of the document, and the range of the lighting LED elements 12*b* of the charge partially erasing device 12 is already set based on the sheet size data stored in the ROM 122. On the other hand, the range of the LED elements 12*b* are turned on is determined with a meet the AND conditions between an erasing area determined based on the sheet size data and erasing area determined based on the region to be copied. In this case, the number of times one of the document size key 76*a*, 76*b*, . . . is operated, is counted by the counter 140, and based on the number counted, one of the partial erase patterns shown in FIGS. 5A to 5E is designated. For example, as in the example shown in FIG. 5B, when a document placed on the original board 52 is a laterally placed A5, a copy sheet is a laterally placed A4, and the copying magnification is 100%, the A5 size button 76*d* of the document size key 76 is operated two times in order to copy the image of the document to the right-hand side section of the sheet (in other words, a blank is formed in the front end side of the A4 sheet) (STP 5). In order to setting the area of erasing of the image to be copied, one of the edit area entry key pads 88*a* to 88*e* each corresponds to the trimming region L, R, M, U and B, is depressed, so as to erase the region to be copied. It is needless to say, in the case that the edit area entry key pads 88*a* to 88*e* are located, the functions of the document size keys 76*a* . . . of the group of size key 76 are shifted onto the edit area entry key pads 88*a* to 88*e*.

When the A5 size button 76*d* of the document size key 76 is operated two times, the indication, "A5-R" is indicated in the erase size flag (not shown) in the easy edit task, and those of the LED 96 corresponding to the "A5" of the document size LED are turned on at a cycle in the interval T shown in FIG. 6C. Further, the display shown in FIG. 7B is displayed on the LCD 92 (STP 6).

After the step STP 6, the erasing pattern corresponds to the number N of the times sheet size key (A5 size button 76*d*) is readout from the ROM 122 by the control of the CPU 110 (STP 7).

Subsequently, an erasing portion on the sheet selected by the cassette switch key 78 is designated in accordance with the erasing pattern designates by the sheet size key 76*d* (STP 8).

After the step STP 8, as regards the lighting timing of the LED elements 12*b*, the "product" of the data (to be called sheet reference LED data, hereinafter), for lighting the LED elements 12*b* set in accordance with the size of sheets in a cassette, detected already by the sheet size detection switches 27*a* and 27*b* in the slots 24*a* and 24*b* and the data (document reference LED data, hereinafter) for lighting the LED elements 12*b* set in accordance with the size of a document input via the group of document size key 76*d*, is calculated by the CPU 110, and the data (called lighting LED data, hereinafter) for actually lighting the LED elements 12*b*. The data are stored in the RAM 124 (STP 9).

In a case that, if a further erasing condition is added (STP 10 - Yes), the erasing pattern based on the added erasing pattern designates by the edit input portion 80 is readout from the ROM 122 (STP 11).

After the step STP 11, for example, in the case where the margin erase key 86 is operated after the document size key 76*d* in step STP 10 - Yes, the "product" of the document reference LED data and the data (margin erase LED data) for the margin erase mode, stored in the ROM 122, is further calculated by the CPU 110, and the lighting LED data stored in the RAM 124 (in STP 9) is rewritten by the new data (STP 12).

Subsequently, when the copy start key 72*a* is operated, the photosensitive drum 10 is charged predetermined surface potential by .the charge device 14 (STP 13). After that the charge partially erasing device 12 is activated in order to make the range of the image forming (STP 14).

After the step STP 14, a latent image corresponds to the image of the document is formed on the photosensitive layer 10*a* of the photosensitive drum 10. A toner image which corresponds to the image of the document is formed in the range of the image forming area defined by the charge partially erasing device 12 of the photosensitive layer 10*a* on the photosensitive drum 10 by the developing device 16 (STP 15).

The toner image formed on the photosensitive layer 10*a* is moved along the rotation of the photosensitive drum 10, and a sheet which was in the state that the leading end of the sheet held by the timing roller 34 fed from the selected cassette 26*a* or 26*b* is aligned with the leading end of the toner image, is moved from the timing roller 34, and delivered to the transfer section located between the transfer device 18 and the photosensitive drum 10 as the photosensitive drum 10 rotates. Thus, the toner image is transferred on the sheet by the transfer device 18 (STP 16).

The toner image transferred on the sheet is transported through the conveying belt 38 toward the fixing device 36, and to fix onto the sheet with the fixing device 36 (STP 17).

In the meantime, the charge device 14 and the illumination lamp 62 are respectively turned off in accordance with the control data corresponding to the size of a document input via the document size key 76. The pulse motor which drives the first and second carriages 60*a* and 60*b* is reversed similarly based on the control data corresponding to the size of the document.

With the operations of mentioned above, even if the size of a sheet is larger than the size of a document, the extra portion of a copied sheet, with respect to the copy area input via the document size key 76 is left blank.

Thus, even in the case where a document is copied on a sheet having a size larger than that of the sheet, a white blank portion can be easily formed on the sheet without a complicated operation.

Figure 9A:
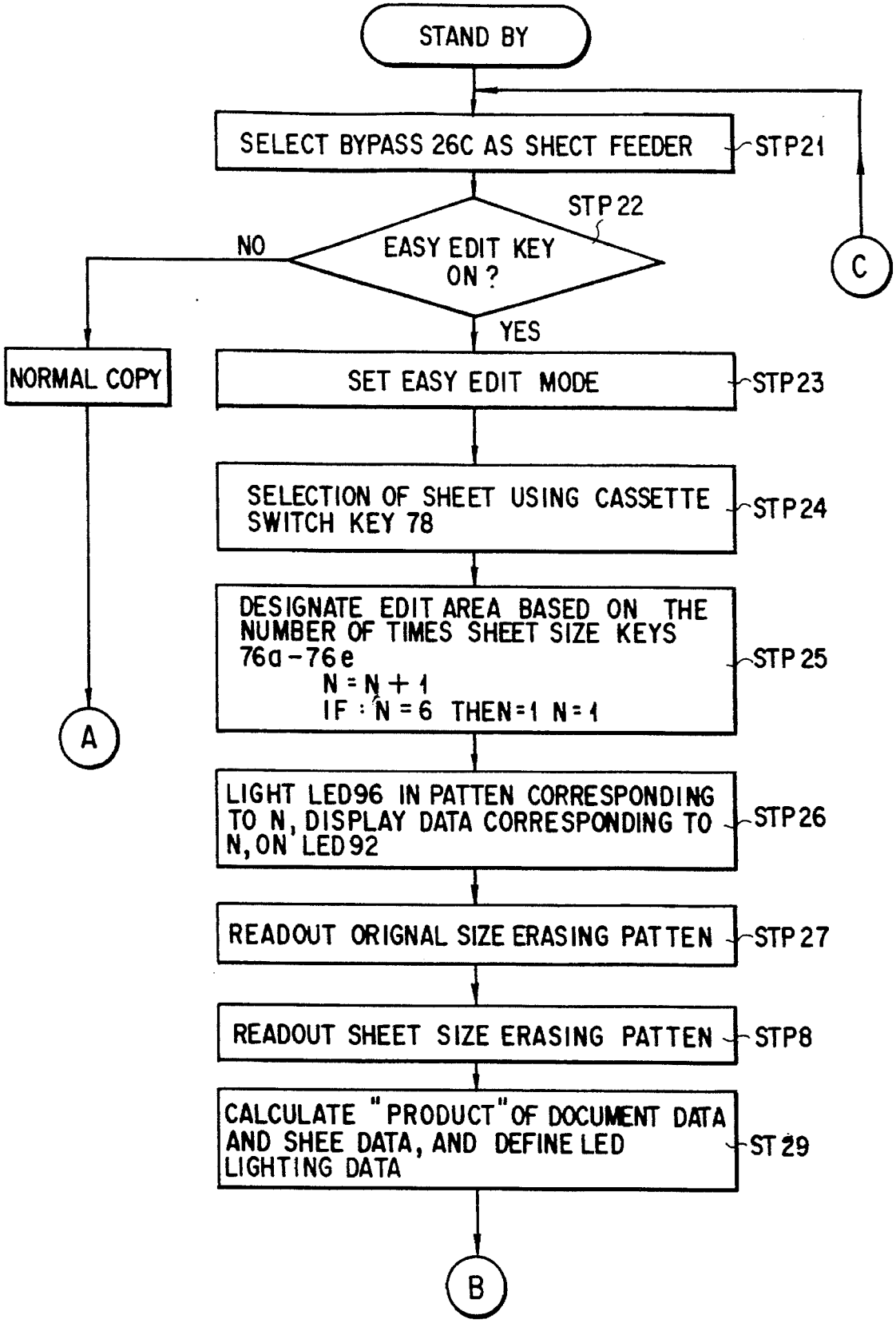
FIGS. 9A and 9B are flowcharts showing another version of the operation shown in FIGS. 8A and 8B.
Figure 9B:
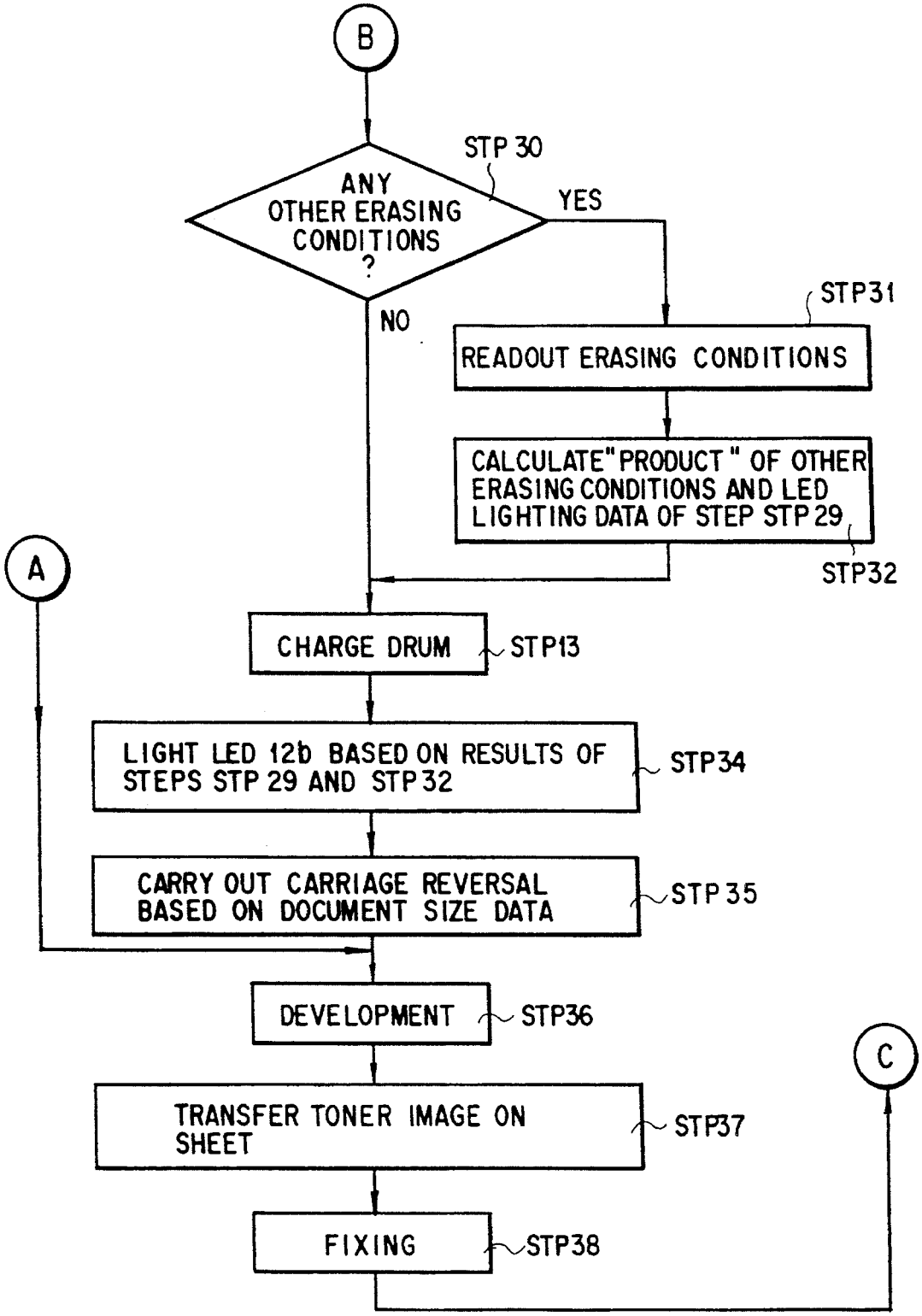

FIGS. 9A and 9B show another version of the copying operation illustrated in FIGS. 8A and 8B.

First, in the standby (ready to copy) state, the cassette switch key 78 is operated in a plurality of times, and the bypass tray 26*c* is selected as a sheet feeder. Thus, the copy sheet is set in a state of being ready to feed from the bypass tray 26*c* (STP 21).

During this state, if the simplified edit mode key 88 is turned on before the copy start key 72*a* is operated, the interruption acceptance state is set in the control routine of the CPU 110, and the copying condition based on the data subsequently input is set (STP 22).

In the case where the easy edit key 88 is turned on during the carrying out of STP 12, the easy edit task is started, and the simplified edit mode display LED located close to the easy edit key 88 is turned on, in similar to the operation shown in FIGS. 8A and 8B (STP 23).

In the simplified edit mode, a sheet having a predetermined size stored in a plurality of cassettes 26*a* and 26*b* is selected using the cassette switch key 78 (STP 24).

By means of the CPU 110, the lighting LED data set in accordance with the size of a document input via the document size key 76 (76*a*, 76*b*, . . . ) is read out from the ROM 122, and the lighting LED data newly obtained is stored in the RAM 124 regardless of the size of the sheet set in the bypass tray 26*c*. In this case, as already described, the number of times the document size key 76 (76*a*, 76*b*, . . . ) is operated is counted (STP 25), and one the partial erase patterns shown in FIGS. 5A to 5E is selected based on the number counted (STP 26).

After the step STP 26, the erasing pattern corresponds to the number N of the times sheet size key (A5 size button 76*d*) is readout from the ROM 122 by the control of the CPU 110 (STP 27).

Subsequently, an erasing portion on the sheet selected by the cassette switch key 78 is designated in accordance with the erasing pattern designates by the sheet size key 76*d* (STP 28).

Then, a pattern corresponding to the size of a document input via the document size key 76*d* is read out from the document reference LED data ROM 122, and the lighting LED data corresponding to all the area of the image region which is larger than that of the document reference LED data, is calculated, and stored in RAM 124 (STP 29).

In a case that, if a further erasing condition is added (STP 30 - Yes), the erasing pattern based on the added erasing pattern designates by the edit input portion 80 is readout from the ROM 122 (STP 31).

After the step STP 31, in the case where, for example, the margin erase key 86 is operated in addition to the document size key 76 (76*a*, 76*b*, . . . ), the "product" of the document reference LED data and the margin erase LED data is calculated and new lighting LED data is thus determined, by which the lighting LED data currently stored in the RAM 24 is rewritten (STP 32).

After the step STP 32, a latent image corresponds to the image of the document is formed on the photosensitive layer 10*a* of the photosensitive drum 10.

When, the copy start key 72*a* is turned on, the photosensitive layer 10*a* on the photosensitive drum 10 is charged predetermined surface potential by the charge device 16 (STP 33). After charging the photosensitive layer 10*a*, the charge partially erasing device 12 is bit in order to make a range of the image forming (STP 34). Meanwhile, the charge device 14 and the illumination lamp 62 are turned off in accordance with the control data corresponding to the size of the document input via the document size key 76 (76*a*, 76*b*, . . . ), and the first and second carriages 60*a* and 60*b* are reversed at predetermined positions to a starting position (STP 35).

After that, as in the operation illustrated in FIGS. 8A and 8B, a toner image corresponding to the image of the document is formed in the range of the image forming area defined by the charge partially erasing device 12 of the photosensitive layer 10*a* on the photosensitive drum 10 (STP 36). The toner image formed on the photosensitive layer 10*a* is transferred onto the sheet fed out from the bypass tray 26*c* by the transfer device 18 (STP 37).

The toner image transferred on the sheet is transported through the conveying belt 38 toward the fixing device 36, and to fix onto the sheet with the fixing device 36 (STP 38).

Even in the case a copy sheet is fed from the bypass tray 26*c* in mentioned above, a copied sheet having a blank in the section not covered by the copying region input via the document size key 76 (76*a*, 76*b*, . . . ) is output.

According to this example, the area of the image to be copied is determined in accordance with the size of a document (or an input copy region), regardless of the size of a copy sheet, thereby surely preventing an unnecessary consumption of the toner.

As described, with the copying machine of the present invention, it is possible to partially erase an electrostatic latent image formed on the photosensitive drum by lighting LED elements, the lighting arrangement of which can be arbitrarily changed, in an area predetermined by inputting and determining the size of an document (or a copying region). Therefore, of a copy sheet having a size larger than an original document (or an image region determined by a copying magnification), is used, an undesired image (black margin) created in the periphery portion of the image region can be eliminated. Consequently, the attraction of toner on an originally unnecessary image forming region can be prevented, thereby inhibiting an unnecessary consumption of the toner. Further, the image forming region can be easily limited by merely inputting the size of an object, and therefore a complicated input operation is not necessary. Also, the image of a document which is smaller than a copy sheet can be copied on the sheet at a desired position with a blank, simply by specifying an erase pattern for its partial erase.

The above embodiment was described in connection with the structure including a plurality of light shielding cells 12*a* extending along the direction of the axial line of the drum 10 as the charge partially erasing means, and erase LED elements 12*b* each provided in each of the light shielding cells 12*a*; however the present invention is not limited such an embodiment, and for example, the charge width can be controlled by providing a shutter member moved by a pulse motor for the charge device 14.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus for reading an image of an original and forming a read image on an image bearing member, comprising:

means for storing a plurality of erase patterns associated with each of a plurality of pattern sizes;

means for selecting one erase pattern out of the plurality of erase patterns stored in said storing means, and for permitting selection of other of the plurality of erase patterns stored in said storing means during subsequent uses of the image forming apparatus;

means for applying a charge uniformly on the image bearing member; and means for erasing a portion of the charge applied on the image bearing member by said applying means in accordance with the erase pattern selected by said selecting means.

2. An image forming apparatus according to claim 1, wherein a position of the erase pattern is changed each time said selecting means is operated.

3. An image forming apparatus according to claim 1, further comprising:

means for displaying a relative position of an erase pattern selected by said selecting means, as in a sheet having a predetermined size.

4. An image forming apparatus for forming an image on a photosensitive member based on a read image read from an original, and transferring the image formed on the photosensitive member on a sheet, comprising:

first storage means for storing sizes of a plurality of erase areas;

sheet size designation means for designating a size of the sheet;

second storage means for storing positions of said plurality of erase areas;

first selection means for selecting one of the sizes of said plurality of erase areas stored in said first storage means;

second selection means for selecting one of the positions of said plurality of erase areas stored in said second storage means;

means for applying a charge uniformly on the photosensitive member; and means for erasing a portion of said charge applied on the photosensitive member by said applying means, which corresponds to an area belonging to at least one of the first erase area selected by said first selection means and the second erase area selected by said second selection means.

5. An image forming apparatus according to claim 4, wherein a position of the erase pattern is changed each time said original size designation means is operated.

6. An image forming apparatus according to claim 4, further comprising:

means for displaying a relative position of an erase pattern selected by said original size designation means, as in the sheet having the size designated by said sheet size designation means.

7. An image forming apparatus comprising: a photosensitive member;

means for applying a charge uniformly on said photosensitive member;

means for selectively lighting so as to remove a portion of the charge applied on said applying means, said lighting means having a plurality of light emitting elements arranged so as to be close to the photosensitive member, and over an entire width of the photosensitive member in a rotational axis direction of the photosensitive member;

means for storing a plurality of erase patterns used to erase an image located within a predetermined range with respect to a sheet having a predetermined size;

means for selecting one erase pattern out of the plurality of image erase patterns stored in said storing means, and for selecting other erase patterns out of the plurality of image patterns stored in said storing means during subsequent uses of the image forming apparatus; and means for controlling said lighting means to remove a portion of the charge from the photosensitive member on a surface of which the charge was uniformly applied, which corresponds to the image erase pattern, by lighting light-emitting elements in accordance with the image erase pattern selected by said selecting means.

* * * * *